US005800296A

United States Patent [19]

Shaw

[11] Patent Number: 5,800,296

[45] Date of Patent: Sep. 1, 1998

[54] HEIGHT ADJUSTED BACKBOARD

[75] Inventor: Dan Shaw, Clinton, Conn.

[73] Assignee: Jaypro Sports, Inc., Waterford, Conn.

[21] Appl. No.: 848,857

[22] Filed: May 1, 1997

[51] Int. Cl.[6] ..... A63B 63/08

[52] U.S. Cl. ..... 473/483

[58] Field of Search ..... 473/483

[56] References Cited

U.S. PATENT DOCUMENTS

| | | |
|---|---|---|
| 2,916,288 | 12/1959 | Chervenka . |
| 3,251,570 | 5/1966 | Frost et al. . |
| 3,964,743 | 6/1976 | Salsich, Sr. . |
| 3,970,304 | 7/1976 | Ebstein et al. . |
| 4,395,040 | 7/1983 | White . |
| 4,500,064 | 2/1985 | Calabro . |
| 4,643,422 | 2/1987 | Cramblett . |
| 4,781,375 | 11/1988 | Nye . |
| 4,798,381 | 1/1989 | Dadbeh . |
| 4,941,661 | 7/1990 | Lykens . |
| 4,948,127 | 8/1990 | Willard . |
| 5,114,141 | 5/1992 | Mahoney . |
| 5,279,496 | 1/1994 | Schroeder . |

FOREIGN PATENT DOCUMENTS

| | | |
|---|---|---|
| 826.546 | 4/1938 | France . |

*Primary Examiner*—William H. Grieb

*Attorney, Agent, or Firm*—Kane,Dalsimer,Sullivan,Kurucz, Levy,Eisele and Richard, LLP

[57] ABSTRACT

An adjustment assembly for adjusting the height of a backboard which includes an assembly to which the backboard is mounted, a rear assembly mounted to a pole or mast, with the rear assembly being stationary and the front assembly being slidably moved with respect thereto by way of a screw positioned therebetween.

8 Claims, 5 Drawing Sheets

HEIGHT ADJUSTED BACKBOARD

FIELD OF THE INVENTION

The present invention relates to an adjustable backboard for use in sports such as basketball.

BACKGROUND OF THE INVENTION

In sports, particularly basketball, a backboard is provided on which the basketball rim is mounted. Commonly, backboards are mounted upon stationary poles mounted to the floor. Alternatively, backboards are mounted on poles or mounts secured to the ceiling or a wall. From time to time it is desirable that the position or height of the backboard be adjustable. This allows it to be, for example, retracted when not in use so as not to interfere with other sports being played or removed from line of sight when, for example, a gym is being used for an auditorium function.

Also, an adjustable backboard is also desirable to lower its height when small, young people are playing to increase their chances of making a basket to spur interest in the game.

In addition, since often times spectators sit behind the backboard, it has become desirable to make it out of glass to provide a visualization of the action in front. Therefore it is not desirable to have an obvious large portion of the backboard obscured by mounting mechanisms. Rather, it is desirable to minimize the size of the mounting mechanism.

SUMMARY OF THE INVENTION

It is therefore a principle object of the invention to provide for a backboard which is height adjustable.

It is a further object to provide for such a backboard to include a height adjustment mechanism which is simple yet effective while minimizing its size to limit the amount it obscures one's view through a transparent backboard.

This and other objects will be realized by the present invention which provides for an adjustment mechanism on the rear of a backboard. The adjustment mechanism includes a front assembly to which the backboard is mounted and a rear assembly which is mounted on a mast, pole or other support member attached to a ceiling or wall. The front and rear assemblies slidingly engage each other with the backboard being raised or lowered by way of a screw member and its relatively compact nature minimizes obstruction.

BRIEF DESCRIPTION OF THE DRAWINGS

Thus by the present invention its objects and advantages will be realized the description of which should be taken in conjunction with the drawings wherein.

DETAILED DESCRIPTION OF THE PREFERRED EMBODIMENT

Figure 1:
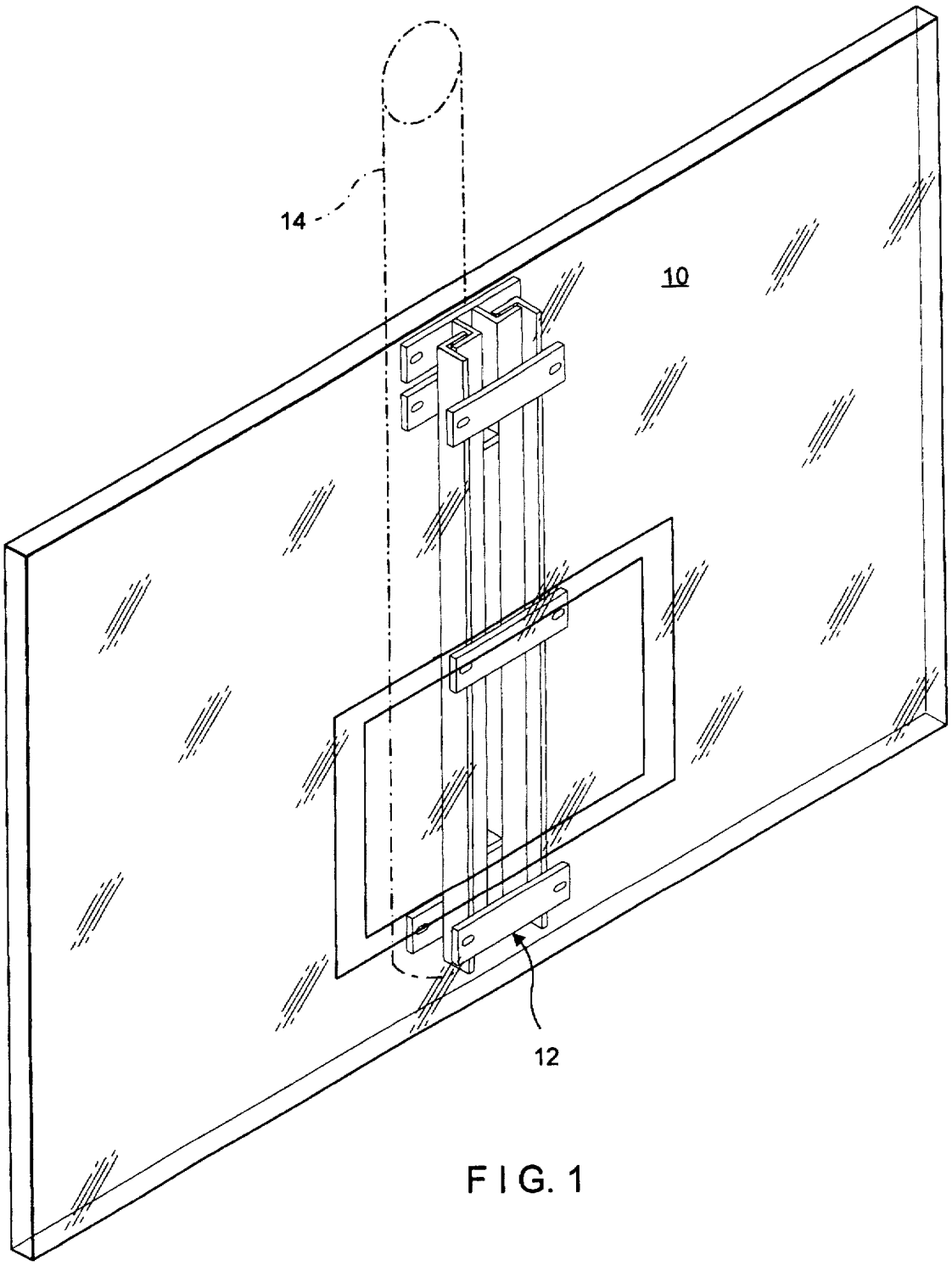
FIGS. 1 and 2 are perspective views showing the backboard in its raised and lowered positions respectively, incorporating the teachings of the invention.
Figure 2:
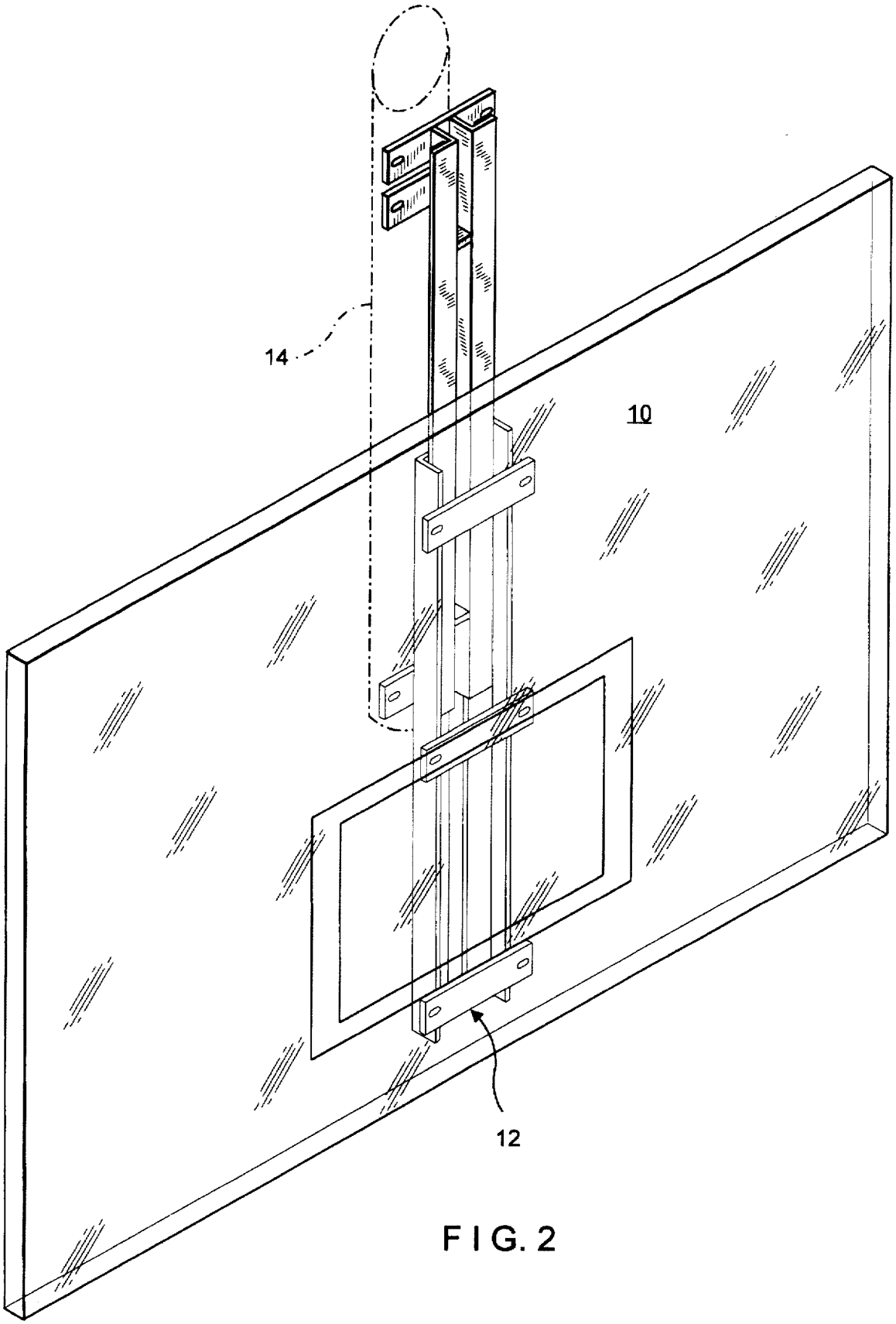
Figure 5:
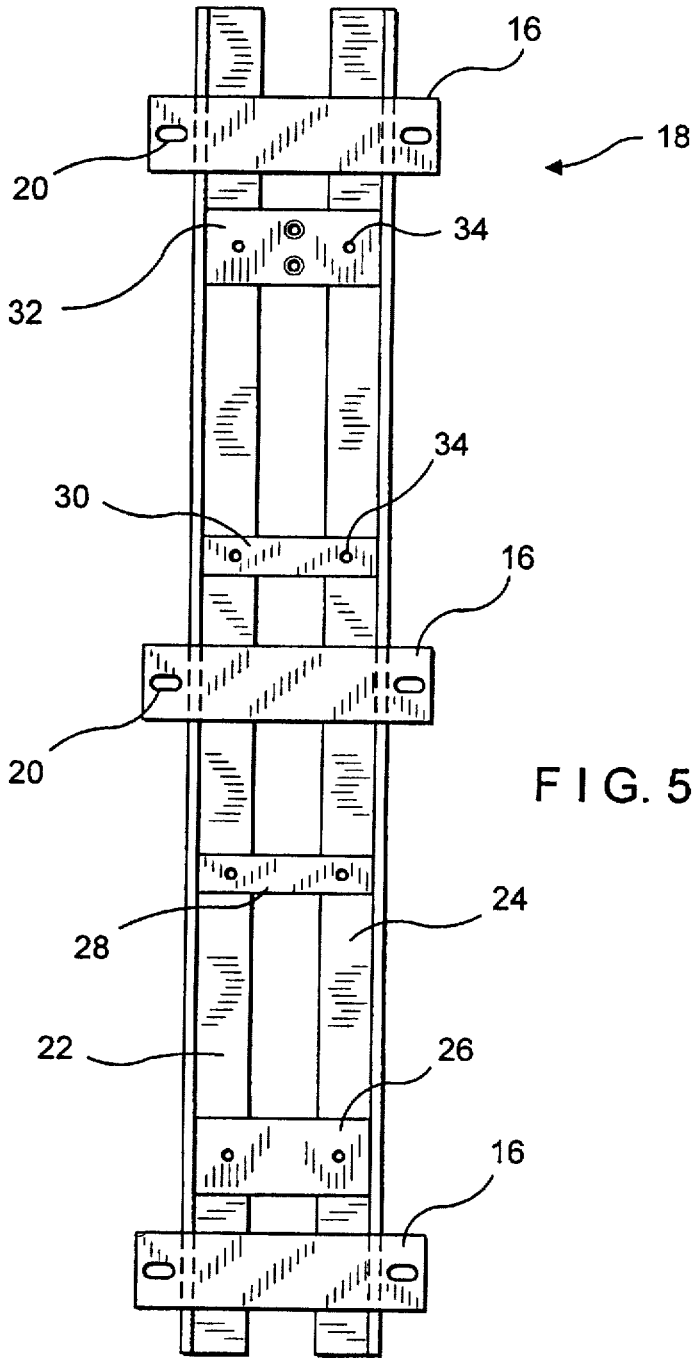
FIG. 5 is a perspective view of the front assembly incorporating the teachings of the present invention.
Figure 5A:
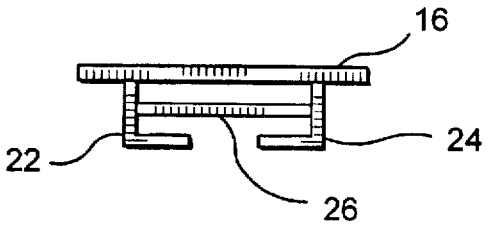
FIG. 5A is a side longitudinal view of the front assembly incorporating the teachings of the present invention.

Turning now more particularly to the drawings, there is shown a backboard 10 made of a transparent material such as glass. The backboard 10 is mounted to an adjustment mechanism or assembly 12 which in turn is mounted to a mast or pole 14. This in turn may be mounted to a ceiling or is otherwise rigidly affixed. In FIG. 1 the backboard is shown in the raised position whereas FIG. 2 shows it in the lowered position. The backboard 10 is mounted to an adjustment mechanism 12 by way of three brackets 16 which are positioned on a front assembly 18 shown most clearly in FIGS. 5 and 5A. Note, the parts mentioned herein may be made of metal unless otherwise stated. Brackets 16 may be welded or the like to assembly 18 and include openings 20 for screws to mount it to the back of the backboard 10. Assembly 18 includes two parallel spaced L-shaped members 22 and 24. Affixed between said members 22 and 24 by welding or the like are four support members 26, 28, 30 and 32. Between these members and the arm areas of the L-shaped members is a gap of approximately ½ inch. The support members 26–32 include threaded openings 34 for nylon tip set screws 36 shown in FIG. 3A for reasons that will be further discussed.

Figure 4:
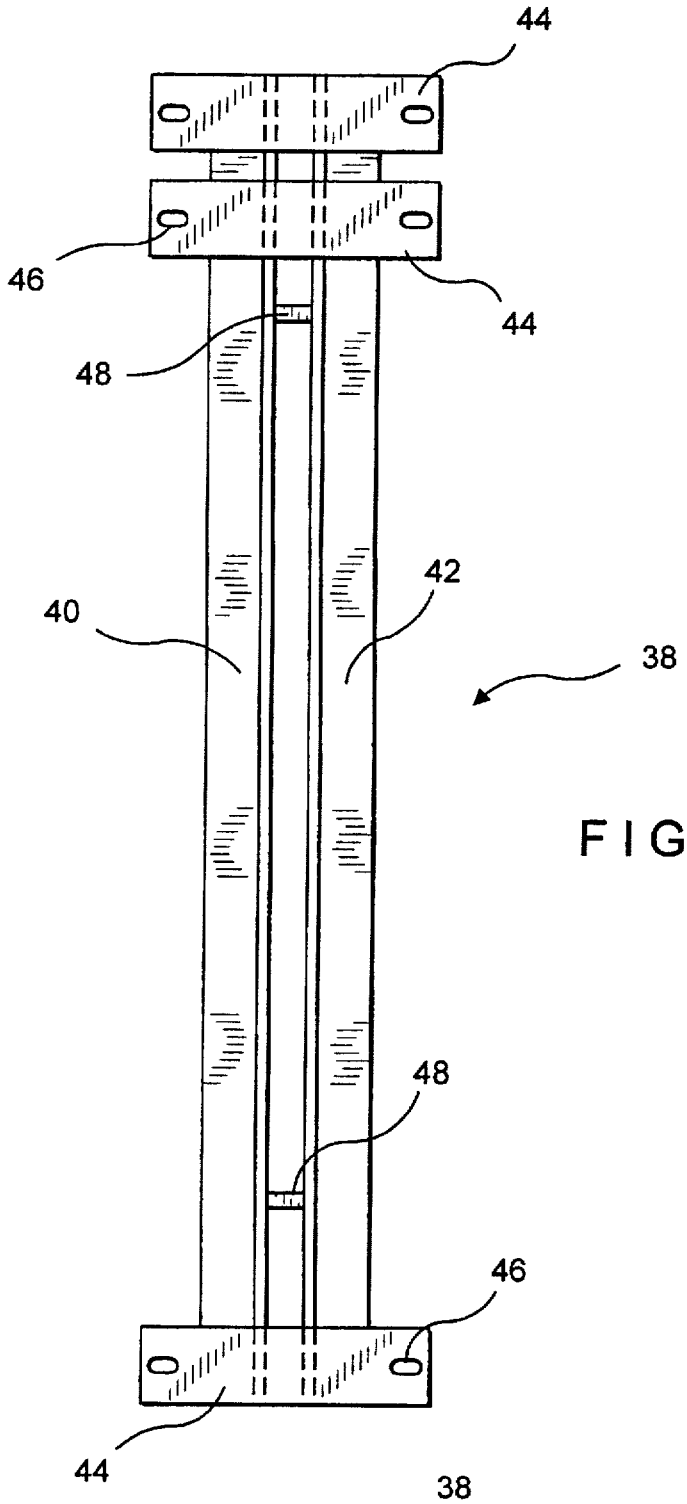
FIG. 4 is a perspective view of the rear assembly incorporating the teachings of the present invention.
Figure 4A:
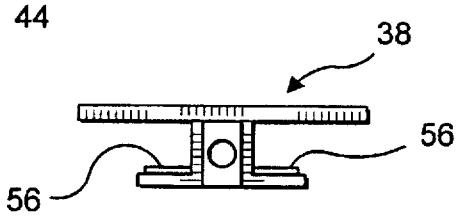
FIG. 4A is a side longitudinal view of the rear assembly incorporating the teachings of the present invention.

Turning now to FIGS. 4 and 4A a metal rear or mast assembly 38 is shown. Assembly 38 includes two spaced parallel L-shaped members 40 and 42. As compared to assembly 18 where the L-shaped members 22 and 24 face each other, in assembly 38 they are back to back.

Affixed by welding or the like to members 40 and 42 are three mounting brackets 44, two at the top and one at the bottom, with opening 46 to allow it to be affixed to the mast 14 via screws or clamps.

Figure 6:
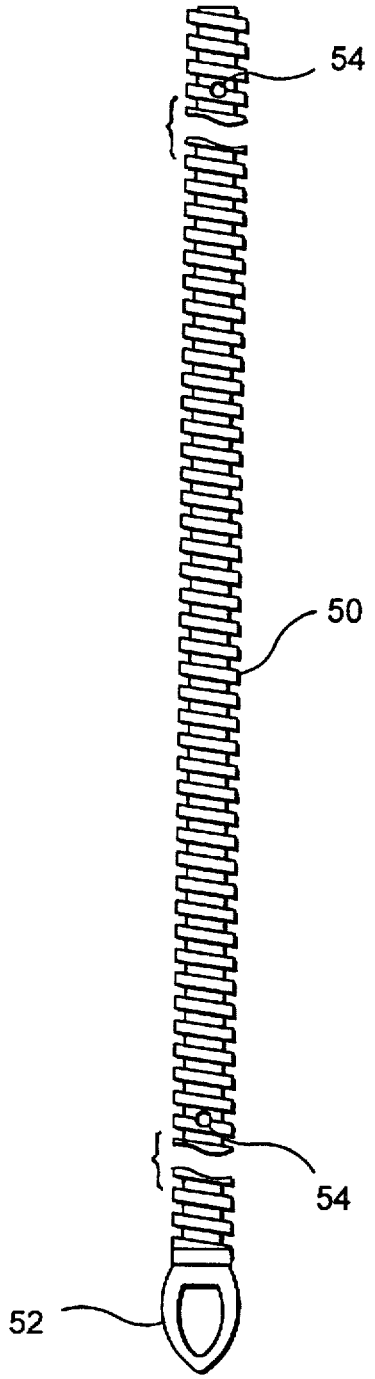
FIG. 6 is a perspective view of the rod assembly incorporating the teachings of the present invention.

Intermediately, affixed between the legs of members 40 and 42 are two collars 48 having set screw (not shown). The collars 48 serve to support a rod or screw 50 shown in FIG. 6. Screw 50 includes an eye socket 52 and includes two circumferential dimples 54. The dimples 54 allow the screw 50 to rotate in the collars 48 with the set screws being threaded down and positioned in the dimples 54.

Assembly 38 provides for Teflon® or friction reducing tape 56 or some other medium suitable for purpose to be provided on the inner arms of members 40 and 42 to allow ease of sliding between assemblies 18 and 38 as will be apparent.

Figure 3:
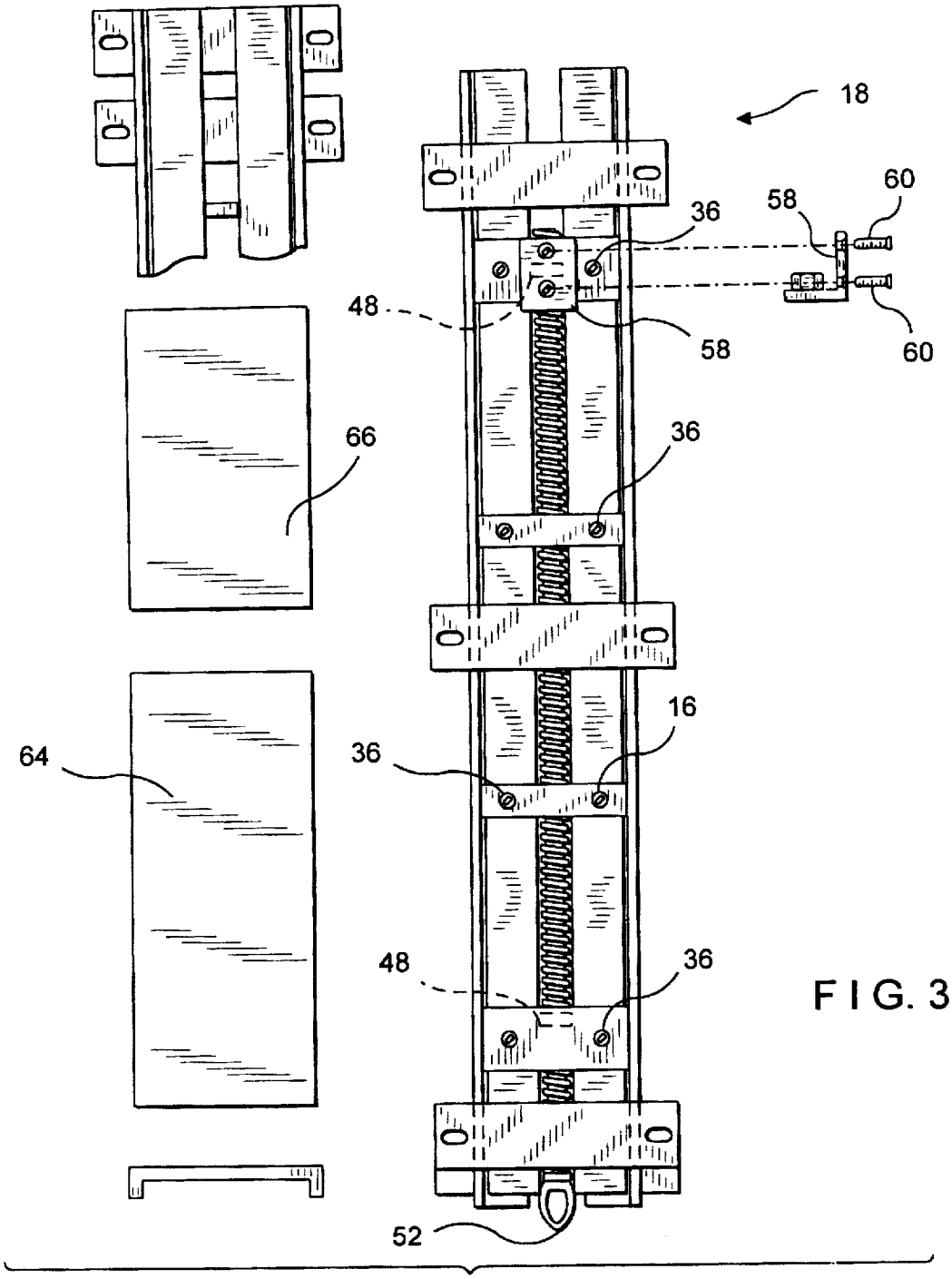
FIG. 3 is a perspective view of the adjustment mechanism with respective covers removed, incorporating the teachings of the present invention.
Figure 3A:
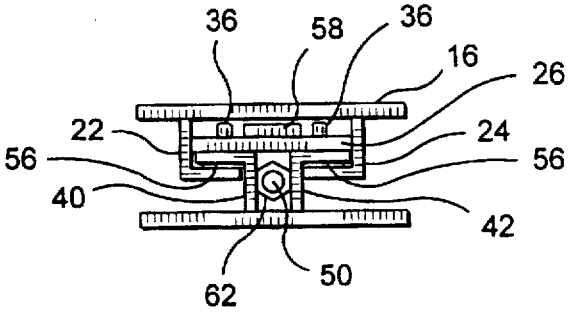
FIG. 3A is a side longitudinal view of the adjustment mechanism incorporating the teachings of the present invention.

In this regard reference is made to FIGS. 3 and 3A wherein a somewhat completely assembled adjustment mechanism 12 is shown. In this regard screw 50 is mounted on assembly 38 with assembly 18 placed in sliding engagement with assembly 38. Prior to finally mounting screw 50, however, it is threaded through a screw nut plate assembly 58 which is mounted on support 32 via screws 60. Assembly 58 comprises an L-shape bracket which includes a hex nut 62 fixedly attached on it arm through which screw 50 is threaded. Once threaded through the screw 50 it then passes through the top collar 48 and the set screws are set once they are so positioned to be located in the dimples 54. The nylon tipped set screws 36, eight in all, are used to adjust for any space as between the brackets 26–32 and members 40 and 42. Accordingly, as between members 18 and 38, the L-shaped members have Teflon tape 56 providing a sliding surface on one side and the nylon tips of screws 36 provide a sliding surface as between the brackets 26–32 of assembly 18 and members 40 and 42 of assembly 38.

Two covers 64 and 66 are provided and may be used to give the mechanism a stream-lined look. In operation a crank can be used engaging eye socket 52. By turning the crank and, in turn, screw 50 this causes the front assembly 18 to ride up or down the screw 50 depending on which way it is turned due to the engagement of the screw nut plate assembly 58 mounted on assembly 18. The screw 50 remains stationary on assembly 38 and by simply turning the screw 50, the backboard 10 can be raised or lowered. It has been found that the adjustment mechanism 12 can be made having a relatively narrow width of approximately 6⅝" which is narrower than the typical post or mast 14 which are on the order of approximately 9" wide. Thus the mounting of adjustment mechanism 12 will not reduce spectator view.

Thus by the present invention its objects and advantages are realized, and although a preferred embodiment has been disclosed and described in detail its scope should not be limited thereby, rather its scope should be determined by that of the appended claims.

What is claimed is:

1. A device for affixing a backboard to a structure and allowing the height of the backboard to be adjusted, comprising:

height adjustment mechanism having a first member affixed to a backboard having a front and rear face and a second member for affixing to a structure to maintain said second member in a stationary position with respect thereof;

said first member slidably engaging said second member with movement of the first member resulting in movement of the backboard;

screw means coupled to said first member and said second member for moving the first member with respect to the second member;

said first member and said second member having opposite portions that overlap and slidably engage each other; and said device being a substantially compact rectangular shape and affixed to the rear face of the backboard whilst being centrally positioned thereon and said opposite portions also being centrally positioned in the device and substantially coextensive with each other when the backboard is in an up position.

2. The invention in accordance with claim 1 wherein said screw means is supported by said second member, said first member includes means for engaging said screw means whereupon rotation of the screw means causes the first member and backboard to move with respect to the screw means.

3. A device for affixing a backboard to a structure and allowing the height of the backboard to be adjusted, comprising:

height adjustment mechanism having a first member affixed to a backboard and a second member for affixing to a structure, to maintain said second member in a stationary position with respect thereof;

said first member slidably engaging said second member with movement of the first member resulting in movement of the backboard;

screw means coupled to said first member and said second member for moving the first member with respect to the second member; and said first member and said second member having opposite portions that overlap and comprise L-shape members having respective arms that slidably engage each other.

4. The invention in accordance with claim 1 which further includes a plurality of mounting means affixed to the legs of the L-shaped members.

5. The invention in accordance with claim 4 which includes support means for maintaining the respective arms in slideable engagement.

6. The invention in accordance with claim 5 which further includes means for reducing friction between the respective arms.

7. The invention in accordance with claim 6 wherein said means for reducing friction comprises friction reducing tape.

8. The invention in accordance with claim 5 wherein said screw means is supported by said second member, said first member includes means for engaging said screw means whereupon rotation of the screw means causes the first member and backboard to move with respect to the screw means.

* * * * *